US009010538B2

(12) United States Patent
Smolkin et al.

(10) Patent No.: US 9,010,538 B2
(45) Date of Patent: Apr. 21, 2015

(54) APPARATUS AND METHOD FOR MAGNETIC SEPARATION

(71) Applicants: Raphael Smolkin, Yoqneam Illit (IL); Michael Smolkin, Yoqneam Illit (IL)

(72) Inventors: Raphael Smolkin, Yoqneam Illit (IL); Michael Smolkin, Yoqneam Illit (IL); Eduard Smolkin, Yoqneam Illit (IL)

( * ) Notice: Subject to any disclaimer, the term of this patent is extended or adjusted under 35 U.S.C. 154(b) by 49 days.

(21) Appl. No.: 13/910,866

(22) Filed: Jun. 5, 2013

(65) Prior Publication Data

US 2013/0264248 A1 Oct. 10, 2013

Related U.S. Application Data

(63) Continuation of application No. PCT/IL2011/050048, filed on Dec. 8, 2011.

(60) Provisional application No. 61/420,919, filed on Dec. 8, 2010.

(51) Int. Cl.
*B03C 1/18* (2006.01)
*B03C 1/247* (2006.01)
(Continued)

(52) U.S. Cl.
CPC . *B03C 1/18* (2013.01); *B03C 1/247* (2013.01); *B03C 2201/18* (2013.01); *B03C 2201/20* (2013.01); *B03C 1/12* (2013.01); *B03C 1/26* (2013.01)

(58) Field of Classification Search
CPC ..... B03C 1/10; B03C 1/12; B03C 1/16; B03C 1/18; B03C 1/247
USPC ..... 209/214, 219, 222, 225, 227, 636
See application file for complete search history.

(56) References Cited

U.S. PATENT DOCUMENTS 3,690,454 A * 9/1972 Bekhtle et al. ..... 209/38
4,869,811 A 9/1989 Wolanski et al.
(Continued)

FOREIGN PATENT DOCUMENTS

DE 10122569 A1 11/2002
EP 0350196 A2 1/1990
(Continued)

OTHER PUBLICATIONS

M. R. Smolkin et al, Calculation and Analysis of the Magnetic Force Acting on a Particle in the Magnetic Field of Separator. Analysis of the Equations Used in the Magnetic Methods of Separation, IEEE Transactions on Magnetics, Nov. 2006, pp. 3682-3693, vol. 42, No. 11, IEEE.

*Primary Examiner* — Joseph C Rodriguez
(74) *Attorney, Agent, or Firm* — Browdy and Neimark, PLLC

(57) ABSTRACT

An apparatus causes magnetic separation of a first component having relatively strongly magnetic properties from a mixture containing it and at least one other component having relatively weak magnetic properties. Included are a rotatable magnetic source configured for generation of a predetermined non-uniform magnetic field at a predetermined distance from an axis of rotation of the magnetic source, thereby creating a magnetic field region while rotating in a first predetermined direction, and also a rotatable shell mounted around the magnetic source. The rotatable shell is configured for rotating concentrically with the magnetic source in a second predetermined direction to form a conveying channel within the magnetic field region. The conveying channel is configured for conveying the first component within the magnetic field region owing to the attraction of the first component to the exterior surface of the rotatable tubular shell by the magnetic field developed by the rotatable magnetic source.

18 Claims, 7 Drawing Sheets

(51) Int. Cl.
*B03C 1/12* (2006.01)
*B03C 1/26* (2006.01)

(56) References Cited

U.S. PATENT DOCUMENTS

| | | | | |
|---|---|---|---|---|
| 5,207,330 | A * | 5/1993 | Siesco, Jr. | 209/219 |
| 5,394,991 | A * | 3/1995 | Kumagai et al. | 209/212 |
| 5,655,664 | A * | 8/1997 | Barrett | 209/212 |
| 6,330,946 | B1 * | 12/2001 | Allen | 209/219 |
| 6,338,903 | B1 * | 1/2002 | Takigawa et al. | 428/413 |
| 7,726,493 | B2 * | 6/2010 | Van Der Weijden et al. | 209/218 |
| 8,678,194 | B2 * | 3/2014 | Rem et al. | 209/214 |
| 8,757,390 | B2 * | 6/2014 | Masferrer Salas | 209/213 |
| 2007/0034554 | A1 | 2/2007 | Van Der Weijden et al. | |
| 2007/0221542 | A1 * | 9/2007 | Molteni | 209/212 |
| 2008/0029457 | A1 | 2/2008 | Saho et al. | |

FOREIGN PATENT DOCUMENTS

| | | | |
|---|---|---|---|
| EP | 1875967 | A1 | 1/2008 |
| JP | 11347442 | A1 | 12/1999 |
| RU | 2067887 | C1 | 10/1996 |
| SU | 782870 | A1 | 11/1980 |
| SU | 1577839 | A1 | 7/1990 |
| WO | 9829190 | A1 | 7/1998 |
| WO | 0025929 | A1 | 5/2000 |
| WO | 2004082839 | A1 | 9/2004 |
| WO | 2005120714 | A1 | 12/2005 |

* cited by examiner

APPARATUS AND METHOD FOR MAGNETIC SEPARATION

FIELD OF THE INVENTION

This invention is in the field of magnetic separation techniques and relates to a method and an apparatus for separating components having different magnetic properties, and, in particular, to an apparatus and method for magnetic separation of strongly magnetic components from weakly magnetic and non magnetic components.

BACKGROUND OF THE INVENTION

Magnetic separators have been used for many years for separating desired materials from compounds containing them, by passing the compound through a magnetic field generated by permanent magnets or electromagnets. These magnetic separators are generally of two kinds, utilizing, respectively, so-called "dry" and "wet" separating techniques.

Magnetic separation techniques are disclosed, for example, in SU Author Certificates Nos. 782870 and 1577839, and RU Patent No. 2067887, all by the inventor of the present application. The disclosures in these documents relate to, respectively, "wet" separation utilizing a magneto-gravimetric technique, and "dry" separation utilizing high magnetic induction and high gradient magnetic fields.

For example, RU Patent No. 2067887 discloses a three-stage separation technique. The first and second stages are "dry" processes utilizing, respectively, a magnetic field of relatively low induction value and gradient and a magnetic field of relatively high induction value and gradient. The third stage presents a "wet" process utilizing a magneto-gravimetric technique. However, RU Patent No. 2067887 has no indication as to any optimal implementation of any of these stages.

It is known to use separators of a so-called "drum-type" for separating strongly magnetic fractions by a relatively weak magnetic field. For this purpose, a magnetic field system includes stationary magnets and a drum that is rotated with respect to the magnets. Compounds containing products to be separated are fed into a magnetic field region and magnetic fractions contained in the compounds are adhered to the surface of the rotating drum in the vicinity of the magnets, while non-magnetic fractions continue their flow away from the magnetic field region. The adhered products are removed from the magnetic field region by the rotation of the drum and are duly discharged while leaving the magnetic field region. Such drum-type magnetic separators are disclosed, for example, in Bulletin no. H26 of Dings magnetic Group, pp. 1-3, and Handbook 390 "Laboratory and Pilot Size Materials Testing and Handling Equipment for the Process Industries", pp. 67-68.

International Application WO 2000/25929 describes a method and apparatus for magnetic separation of a first component having relatively strongly magnetic properties from a mixture containing the first component and at least a second component having relatively weakly magnetic properties, as compared to those of the first component. A magnetic field source is mounted on a circumference of a drum and rotated in a certain direction with a predetermined speed. The magnetic field source creates a magnetic field region in the vicinity of the drum. The mixture is fed into a separation channel, which is stationary mounted in the vicinity of the drum, and extends along a circumferential portion of the drum. The rotation of the drum can cause the movement of the first component along the separation channel in a direction opposite to the direction of the rotation of the drum. The first and second components are discharged through opposite ends of the separation channel.

A common problem of conventional techniques mentioned above is associated with the undesirable effect of "flocculation", described as follows. When magnetizable material passes through a magnetic field region, it becomes magnetized. Each particle of such material presents a separate magnet having opposite pole pieces. Magnetic forces occurring between these particles cause their conglomeration, trapping non-magnetic material therebetween. This reduces the quality of the separation. In such cases, at least one additional stage of magnetic separation is required.

In some applications, therefore, separation of the materials is performed manually by visual recognition of pieces of different pieces and objects. It is needless to say that the cost of manual separation is considerable, especially in the case of small pieces, for example, used in production of micro-electronic components, such as miniature resistors, capacitance, active elements, etc. As for the manual separation of small ferromagnetic balls (media) used in the Nickel coating process, from Nickel coated electronic components (chips), the use of a microscope is usually required.

GENERAL DESCRIPTION

Despite the existing prior art in the area of magnetic separation techniques, there is still a need in the art for, and it would be useful to have, a novel apparatus and method for more effective and less costly magnetic separation of strongly magnetic components from a mixture containing these components along with weakly magnetic and non magnetic components.

It is a major feature of the present invention to provide such an apparatus, which has a relatively simple construction and provides high quality separation, and in which the above-indicated flocculation-related problem of the strong magnetic particles is eliminated or at least significantly reduced.

It would also be advantageous to provide an apparatus and method having increased productivity, when compared to the prior art apparatuses.

The present disclosure satisfies the aforementioned need by providing an apparatus and method for magnetic separation of a first component in the form of a particulate material having relatively strong magnetic properties from a mixture containing the first component and one or more other components having relatively weak magnetic properties, as compared to those of the first component.

The separation apparatus comprises a rotatable magnetic source configured for generation of a predetermined non-uniform magnetic field at a predetermined distance from an axis of rotation of the rotatable magnetic source, and thereby creating a magnetic field region while rotating in a first predetermined direction, defining a separation zone in the magnetic field region. The separation apparatus also comprises a rotatable tubular shell mounted around the rotatable magnetic source, configured for rotating concentrically with the rotatable magnetic source in a second predetermined direction to form a conveying channel within the magnetic field region for conveying the first component within the magnetic field region owing to attraction of the first component to the exterior surface of the rotatable tubular shell by the non-uniform magnetic field developed by the rotatable magnetic source.

During the conveying, the particulate material can be divided into separated particles owing to their tumbling along the conveying channel. Moreover, when desired, the particles can be washed from impurities.

According to an embodiment of the present invention, the rotatable magnetic source comprises a plurality of magnets having poles extending radially with respect to the axis of rotation, and a magnetic source driver. The magnetic source driver is configured for rotating the rotatable magnetic source in the first predetermined direction at a predetermined magnetic source angular velocity which can be controllably regulated.

According to one example, the magnets are permanent magnets mounted on the outer surface of a support member. The permanent magnets can, for example, include a material selected from the group including Ferrous-Barium (FeBa), Samarium-Cobalt (SmCo), Strontium and rare-earth metals. According to another example, the magnets are electromagnets mounted on the outer surface of a support member.

According to an embodiment, the support member is a drum and the magnets are arranged along the circumference of the drum.

The rotatable tubular shell is associated a tubular shell driver configured for rotating the rotatable tubular shell in the second predetermined direction at a predetermined tubular shell angular velocity which is controllably regulated.

According to an embodiment, the tubular shell driver includes an endless band placed on the exterior surface of the rotatable tubular shell, thereby forming the conveying channel mentioned above that is configured for conveying the first component of the mixture along an outer surface of the endless band. The tubular shell driver includes an electric motor configured for driving the rotatable tubular shell through the endless band.

According to one embodiment, the tubular shell driver includes a band agitator configured for vibrating the endless band near the zone of discharge of the particular elements of the first component from the endless band. According to an embodiment, the band agitator can include a plate made of a non-magnetic material. The plate can bear one or more agitating strips made of a soft magnetic material and mounted in the vicinity of the interior surface of the endless band. Moreover, the plate should be mounted in the proximity to the rotatable magnetic source at a distance sufficient for electromagnetic interaction of the magnets of the rotatable magnetic source with the agitating strips, thereby vibrating and bouncing the endless band. For example, the plate can be mounted at a distance of about 5 mm-50 mm from the zone of discharge of the first component.

According to another embodiment, the tubular shell driver includes an electric motor, and a shell pulley secured to the rotatable tubular shell and rotatably driven by the electric motor through an endless belt cooperative with the pulley.

The apparatus can be associated with a feeder configured for providing the mixture containing the first component having relatively strongly magnetic properties and one or more other components having relatively weak magnetic properties to the magnetic field region.

According to one embodiment, the feeder comprises a hopper and a supplier for delivering the mixture to be separated to the rotatable tubular shell.

According to another embodiment, the feeder comprises a water supply conduit for providing water to the feeder for mixing with the mixture and forming slurry, and a slurry supply conduit coupled to the mixing chamber for delivering the slurry towards the rotatable tubular shell.

The apparatus can be associated with a collector including a first discharge chamber and at least one other discharge chamber configured for separately collecting the first material component and other material component(s), respectively.

According to one embodiment, the apparatus comprises a guiding assembly for guiding the flow of the mixture to the magnetic field region. The guiding assembly defines a feeding zone upstream of the separation zone. According to one embodiment, the guiding assembly comprises a screening assembly preventing the feeding zone from being affected by the magnetic field produced in the separation zone.

According to an embodiment, the screening assembly comprises a chamber having inlet and outlet openings and defining a path for the mixture flow towards the separation zone. The chamber can, for example, be made of a ferromagnetic material.

According to an embodiment, the screening assembly comprises at least one pair of shutters projecting from at least one of the outlet openings and defining a further path for the mixture flow towards the separation zone. The shutters can, for example, be made of a ferromagnetic material.

According to an embodiment, the guiding assembly divides the feeding zone into two spatially separated sub-zones for feeding two spatially separated flows of the mixture towards different paths through the separation zone.

The separation apparatus according to the present invention may be easily and efficiently fabricated and marketed.

The separation apparatus according to the present invention is of durable and reliable construction.

The separation apparatus according to the present invention may have a relatively low manufacturing cost.

The method for magnetic separation comprises:

generating a predetermined non-uniform magnetic field by a rotatable magnetic source at a predetermined distance from an axis of rotation of the rotatable magnetic source and thereby creating a magnetic field region while rotating in a first predetermined direction;

mounting a rotatable tubular shell around the rotatable magnetic source in said magnetic field region;

feeding the mixture containing the first component and at least one other component to the magnetic field region, thereby separating the first component from a mixture; and rotating the rotatable tubular shell concentrically with the rotatable magnetic source in a second predetermined direction to form a conveying channel within the magnetic field region, the conveying channel configured for conveying the first component within the magnetic field region owing to the attraction of the first component to the exterior surface of the rotatable tubular shell by the magnetic field generated by the rotatable magnetic source.

According to an embodiment of the present invention, an angular velocity of the rotatable magnetic source is greater than the angular velocity of the rotatable tubular shell.

According to another embodiment of the present invention, the angular velocity of the rotatable magnetic source is less than the angular velocity of the rotatable tubular shell.

According to an embodiment of the present invention, an angular velocity of the rotatable magnetic source is equal to the angular velocity of the rotatable tubular shell.

According to one embodiment of the present invention, a direction of rotation of the rotatable magnetic source concurs with the direction of rotation of the rotatable tubular shell.

According to another embodiment of the present invention, a direction of rotation of the rotatable magnetic source is opposite to the direction of rotation of the rotatable tubular shell.

According to a further embodiment of the present invention, the method for magnetic separation further comprises the step of washing the particulate material of the first component during its conveying along the exterior surface of the rotatable tubular shell.

According to a further general aspect of the present invention, there is provided a method for magnetic separation of a first component having relatively strongly magnetic properties from a mixture containing the first component and at least one other component having relatively weak magnetic properties as compared to those of the first component, comprising:

providing a predetermined rotatable non-uniform magnetic field and thereby creating a magnetic field region while rotating in a first predetermined direction;

feeding the mixture containing the first component and at least one other component to the magnetic field region, thereby separating the first component from a mixture;

applying a centrifugal force to the separated first component in a second predetermined direction concentrically with the magnetic field to form a conveying channel within the magnetic field region for conveying the first component within the magnetic field region for collecting thereof.

There has thus been outlined, rather broadly, the more important features of the invention so that the detailed description thereof that follows hereinafter may be better understood, and the present contribution to the art may be better appreciated. Additional details and advantages of the invention will be set forth in the detailed description.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
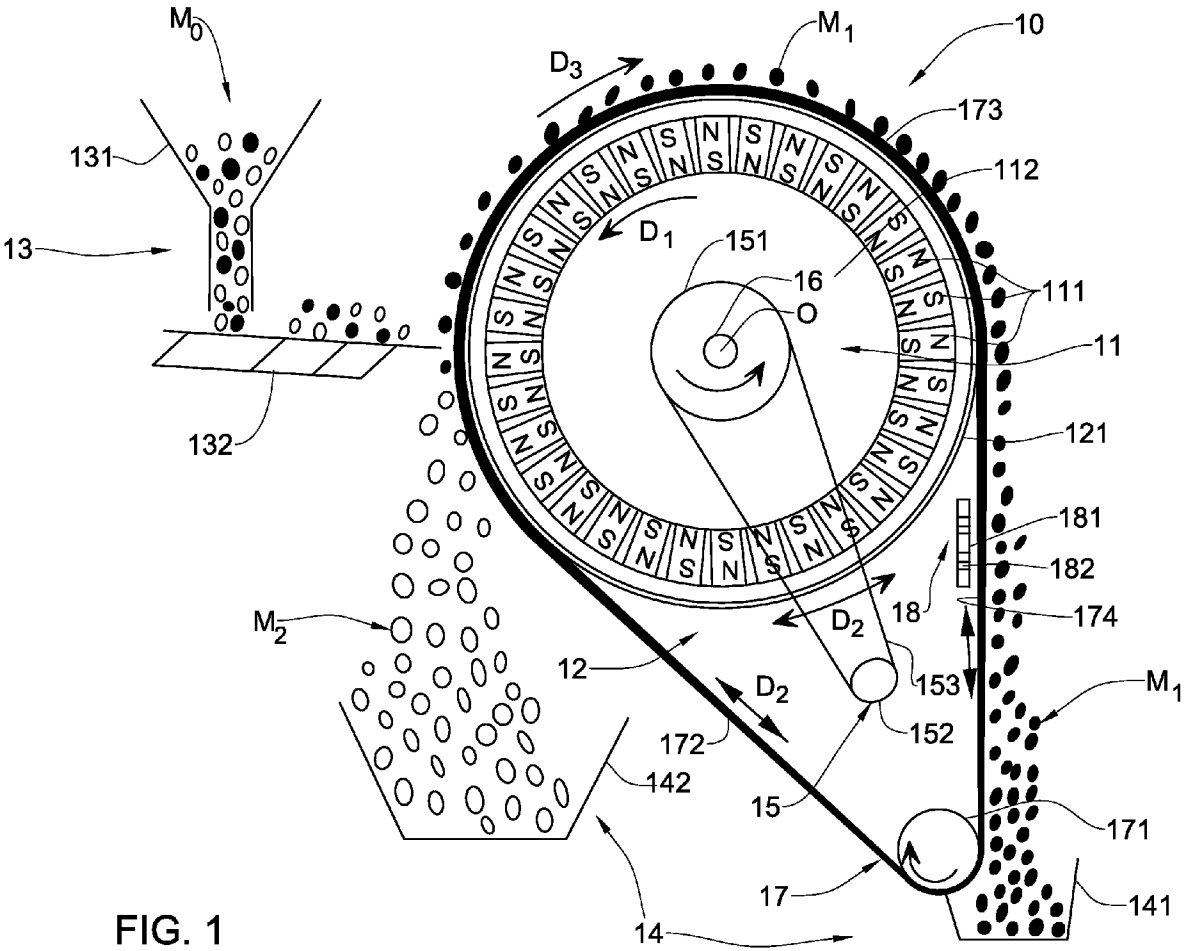
FIG. 1 is a schematic side elevational view of a separation apparatus for dry-type magnetic separation of a first component from a mixture containing the first component and at least one other component, according to one embodiment of the present invention.

The principles and operation of the apparatus and method for magnetic separation according to the present invention may be better understood with reference to the drawings and the accompanying description. It should be understood that these drawings are given for illustrative purposes only and are not meant to be limiting. It should be noted that the figures illustrating various examples of the apparatus of the present invention are not to scale, and are not in proportion, for purposes of clarity. It should be noted that the blocks as well other elements in these figures are intended as functional entities only, such that the functional relationships between the entities are shown, rather than any physical connections and/or physical relationships. The same reference numerals and alphabetic characters will be utilized for identifying those components which are common in the apparatus for magnetic separation and its components shown in the drawings throughout the present description of the invention. Examples of constructions are provided for selected elements. Those versed in the art should appreciate that many of the examples provided have suitable alternatives which may be utilized.

Referring to FIG. 1, a schematic side elevational view of a separation apparatus 10 for magnetic separation of a first component $M_1$ from a mixture $M_0$ containing the first component and at least one other component $M_2$ is shown, according to one embodiment of the present invention. The first component $M_1$ of the mixture $M_0$ includes particular elements having relatively strong magnetic properties when compared to the particular elements of the other component $M_2$ having relatively weak magnetic properties as compared to those of the first component. The particular elements of the first component can comprise a ferromagnetic material, e.g., iron, magnetite and other iron oxides. Examples of the first component include, but are not limited to, media obtained in fabrication of electronic chips, ferromagnetic scrap, etc.

It should be noted that, generally, the components to be recovered from the entire mixture $M_0$ may also contain weakly magnetic and non magnetic materials. The weakly magnetic components can, for example, include paramagnetic materials. Examples of non magnetic materials that represent interest for recovering include, but are not limited to precious metals and minerals, e.g., gold, diamonds, etc.

The separation apparatus 10 generally includes a rotatable magnetic source 11 and a rotatable tubular shell 12 mounted around the rotatable magnetic source 11. The rotatable magnetic source 11 includes a plurality of permanent magnets or electromagnets (indicated by a reference numeral 111) having poles extending radially with respect to the axis of rotation O.

As shown in FIG. 1, the separation apparatus 10 is configured for a "dry-type" separation. In this case, the separation apparatus 10 is associated with a feeder 13 of a "dry-type" configured for providing the mixture $M_0$ to be separated onto the first component $M_1$ and one or more other components $M_2$. When desired, the separation apparatus 10 can include a shield (not shown) for screening the feeder 13 with the supplied mixture $M_0$ from the magnetic field generated by the rotatable magnetic source 11.

The feeder 13 of the separation apparatus 10 can include a hopper 131 and an inclined conduit supplier 132 for delivering the mixture to be separated by gravity to the rotatable tubular shell 12. Instead of the inclined conduit supplier, the feeder can include a supply chute or supply conveyer (not shown) adjacent to the hopper 131 that conveys the mixture to be separated to the rotatable tubular shell 12. When desired, the feeder 13 can include a loading conveyer (not shown) that conveys the mixture $M_0$ from a suitable loading assembly (not shown) to the hopper 131. When desired, the feeder 13 can include one or more agitating elements, configured for vibrating the inclined conduit supplier 132 to facilitate the mixture supply.

The separation apparatus 10 can be also associated with a collector 14 having a first discharge chamber 141 configured for collecting the first component $M_1$ of the mixture $M_0$, and at least one other discharge chamber 142 configured for collecting one or more other components $M_2$.

The rotatable magnetic source 11 is configured for generation of a predetermined magnetic field at a predetermined distance from an axis O of rotation of the rotatable magnetic source 11, and thereby creating a magnetic field region while rotating in a first predetermined direction $D_1$.

Figure 2:
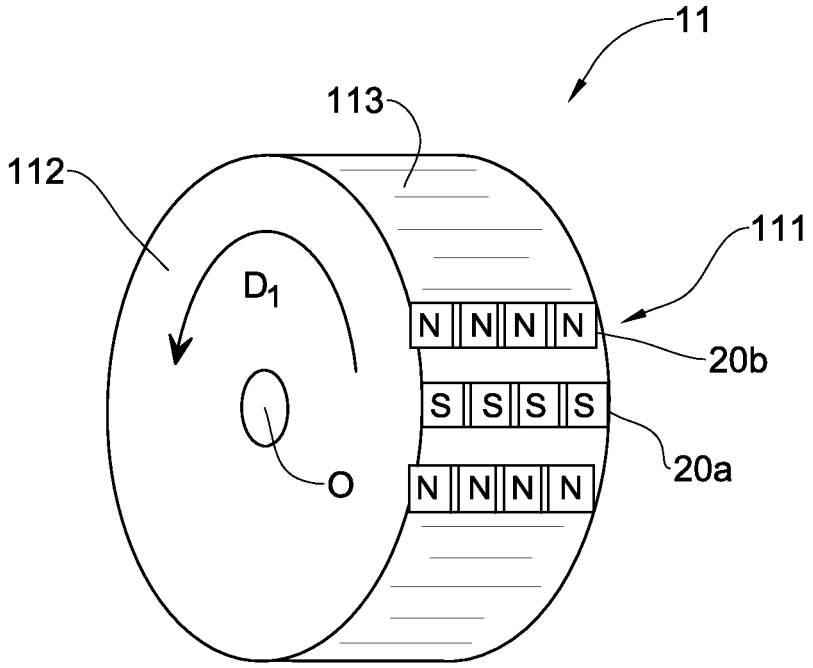
FIG. 2 is a schematic view of the rotatable magnetic source of FIG. 1, according to one embodiment of the present invention.
Figure 3:
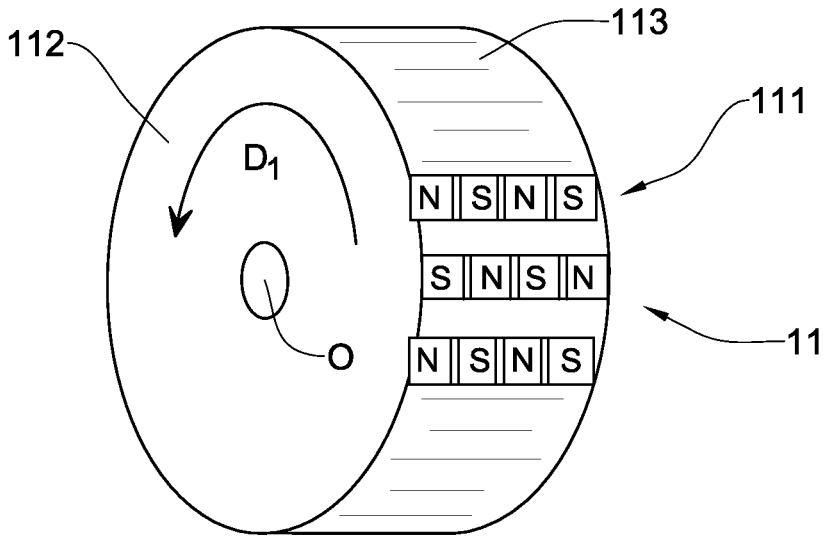
FIG. 3 is schematic perspective view of the rotatable magnetic source of FIG. 1, according to another embodiment of the invention.

Referring to FIGS. 1, 2 and 3, perspective views of the rotatable magnetic source 11 are shown, according to several embodiments of the invention. According to the embodiment shown in FIG. 2, the magnets 111 of the rotatable magnetic source 11 are permanent magnets having poles extending radially with respect to the axis of rotation O. The magnets 111 are mounted on the outer surface of a support member, for example, a drum 112 so as to be rotated together with the drum 112. The magnets 111 are arranged along the circumference 113 of the drum 112, and are oriented such that each South-pole S is enclosed between a pair of North-poles N.

According to the embodiment shown in FIG. 3, the South-poles and North-poles are aligned in two parallel rows 20*a* and 20*b*, respectively, extending parallel to the axis of rotation O of the drum 12. In this case, the South- and North-poles are arranged in a so-called "chess-board order" within the circumference 113 of the drum 112. Other arrangements of the magnets on the drum are also contemplated. The magnets 111 may be shaped like flat, "domino-like", rectangular blocks. The outer surface of each magnet directed outwardly from the rotation axis may be flat, cylindrical, spherical, etc.

When the magnets 111 are permanent magnets, they can, for example, be made of Ferrous-Barium (FeBa), Samarium-Cobalt (SmCo), Strontium or rare-earth metals. These materials allow construction of strong magnets having magnetic induction in the vicinity of the magnet's surface of about 0.15 T-1 T. It should be also understood that when desired, the rotatable magnetic source 11 can also utilize electromagnets (not shown) along with or instead of permanent magnets, mutatis mutandis, with either a radial or axial arrangement of the South and North poles.

It should be understood that although the support member in the form of the drum 112 is shown in FIGS. 2 and 3, when desired, the magnets 111 can also be mounted on any other support members, for example, on spokes associated with a hub (not shown).

Turning back to FIG. 1, the rotatable magnetic source 11 is mounted on a shaft 16 and driven by a magnetic source driver 15 configured for rotating the rotatable magnetic source 11 in the first predetermined direction $D_1$ at a predetermined magnetic source angular velocity $\Omega_1$. The angular velocity $\Omega_1$ can be controllably regulated for achieving the desired distribution of magnetic field in the created magnetic field region. The drum 112 can, for example, be secured to the shaft 16 for rotation together therewith. Alternatively, the drum 112 can be mounted on the shaft 16 via a frictionless bearing or other means.

According to one example, the magnetic source driver 15 can include a pulley 151 secured to the drum 112. The pulley 151 can be rotatably driven from an electric motor (schematically shown by a reference numeral 152) through an endless belt 153 cooperative with the pulley 151. Alternatively, the magnetic source driver 15 can include a sprocket wheel (not shown) secured to the drum 112. The sprocket wheel can in turn be rotatably driven through a chain drive (not shown) from an electric motor.

The rotatable tubular shell 12 can also be mounted on the shaft 16 (for example, via a frictionless bearing or other means), and configured for rotating concentrically with the rotatable magnetic source 11 in a second predetermined direction $D_2$ at a regulated tubular shell angular velocity $\Omega_2$. The rotatable tubular shell 12 has an exterior surface 121 that is located within the magnetic field region created by the rotatable magnetic source 11. The rotatable tubular shell 12 is made from a non magnetic, preferably non conductive material (e.g. plastic), in order to prevent forming curled eddy currents therein, owing to rotation of the permanent magnets 111. The rotatable tubular shell 12 can, for example, be driven by a shell driver (schematically indicated by a general reference numeral 17). The shell driver is configured for rotating the rotatable tubular shell in the second predetermined direction $D_2$ at a predetermined tubular shell angular velocity $\Omega_2$.

According to one embodiment of the present invention, the direction $D_1$ of rotation of the rotatable magnetic source 11 concurs with the direction $D_2$ of rotation of the rotatable tubular shell 12.

According to another embodiment of the present invention, the direction $D_1$ of rotation of the rotatable magnetic source 11 is opposite to the direction $D_2$ of rotation of the rotatable tubular shell 12.

According to one embodiment of the present invention, the angular velocity $\Omega_1$ of the rotatable magnetic source 11 is equal to or greater than the angular velocity $\Omega_2$ of the rotatable tubular shell 12.

According to another embodiment of the present invention, the angular velocity $\Omega_1$ of the rotatable magnetic source 11 is less than the angular velocity $\Omega_2$ of the rotatable tubular shell 12.

According to the embodiment shown in FIG. 1, the shell driver 17 includes an electric motor (not shown) having a pulley 171, and an endless band 172 placed on the exterior surface 121 of the rotatable tubular shell 12 and cooperative with the motor 172. In this case, a conveying channel for conveying the first component $M_1$ of the mixture $M_0$ to the first discharge chamber 141 of the collector 14 is formed on an outer surface 173 of the endless band 172. As the magnets of the rotatable magnetic source 11 rotate, a magnetic field region is formed that causes the magnetic material of the first component to interact with the non-uniform alternating magnetic fields. When the magnetic force associated with the magnetic fields is sufficiently strong, the elements of the first component start to move along the separation channel.

It was found by the inventors that depending on the characteristics of the material of the first component $M_1$, the direction $D_2$ of the rotatable tubular shell 12 should be selected clockwise or counterclockwise. Thus, a direction of motion of the first component along the separation channel should either concur with the direction $D_1$ of motion of the permanent magnets 111 or be opposite to this direction. Likewise, the conveying direction of the first component $M_1$ along the endless band 172 should either concur with the direction of the endless band 172 or be opposite to the direction of the rotatable tubular shell 12.

In the example shown in FIG. 1, the characteristics of the material and magnetic field are such that the direction of the flow of the first component along the separation channel is opposite to the direction $D_1$ of the permanent magnets 111. Furthermore, the rotatable tubular shell 12 can be rotated in a direction $D_2$ that either concurs with the direction of the flow of the first component $M_1$ or is opposite to this direction, thereby facilitating the motion of the first component $M_1$ along the outer surface of the endless band 172 towards the first discharge chamber 141 of the collector 14. Thus, it should be particularly noted that, when desired, a direction of the flow of the first component $M_1$ can also be opposite to the direction of the endless band 172.

For example, the applicant found that the direction of flow of the first component $M_1$ should concur with the direction of the endless band 172 during enrichment of strong magnetic ores. In this case, a direction of rotation of the rotatable magnetic source 11 should concur with the direction of rotation of the rotatable tubular shell 12.

On the other hand, it was found that the direction of flow of the strong magnetic component should be opposite to the direction of the endless band 172 during separation of the waste material obtained from abrading the bottoms of ships. In particular, the material in this case was a mixture of steel balls of different diameters of size 2 mm, rust (from large pieces of 15 mm to fine powder of 200 microns), residues from the welding electrodes of different length and diameter, pieces of metal of various origins of size of 70 mm, and non-magnetic debris of size of 80 mm. It was managed to find a mode in which the magnetic product represented beads and thin rust. The pieces of metal and the electrodes were dropped by the endless band in a non-magnetic product. The rust was further separated from the concentrate by using sieves.

According to another embodiment, the shell driver 17 can include a shell pulley (not shown) secured to the rotatable tubular shell 12. The pulley can be rotatably driven from a separate electric motor (not shown) through an endless belt (not shown) cooperative with the pulley. Alternatively, the shell driver 17 can include a sprocket wheel (not shown) secured to the tubular shell. The sprocket wheel can in turn be rotatably driven through a chain drive (not shown) from the electric motor. In operation, a conveying channel can, for example, be formed along the exterior surface 121 for conveying the first component $M_1$ (having strongly magnetic properties) of the mixture $M_0$ to the first discharge chamber 141 of the collector 14 owing to the attraction of the first component $M_1$ to the exterior surface 121 of the rotatable tubular shell 12 by the non-uniform magnetic field developed by the rotatable magnetic source 11. It should be noted that depending on the material of the first component $M_1$, the direction $D_2$ of the rotatable tubular shell 12 can be selected clockwise or counterclockwise. Accordingly, the conveying direction $D_3$ of the first component $M_1$ along the exterior surface 121 can either concur with the direction $D_2$ of the rotatable tubular shell 12 or be opposite to the direction $D_2$.

In operation, the mixture $M_0$ including particular elements of the first component $M_1$ (having relatively strong magnetic properties) and particular elements of the other component $M_2$ (having relatively weak magnetic properties as compared to those of the first component) is fed to the feeder 13 of the separation apparatus 10. Then the mixture $M_0$ is fed to the magnetic field region, in which the first component is separated from a mixture.

Specifically, the mixture $M_0$ is supplied towards the exterior surface of the rotatable tubular shell 12 so that the first component $M_1$ having relatively strong magnetic properties is interacted with the predetermined non-uniform magnetic field created by the magnets of the rotatable magnetic source rotating in the first predetermined direction $D_1$. The rotation of the magnets produces an alternating magnetic field within the magnetic field region formed along the exterior surface 121 of the tubular shell 12. This magnetic field tends to loosen the strongly magnetic components away from the weakly magnetic and non-magnetic components.

As the mixture $M_0$ approaches the tubular shell 12 and becomes located within magnetic field region, the weakly magnetic and non-magnetic components $M_2$ are not affected by the magnetic field and, therefore, due to the gravity force, the components $M_2$ move downwards, i.e., towards the discharge chamber 142 for collecting thereby. As for the strongly magnetic components $M_1$, both the gravity force and the magnetic field affect them. The effect of the magnetic field results in the adherence of particles of the strongly magnetic components $M_1$ to the exterior surface of the tubular shell 12, or to the outer surface of the endless band 172 for the case shown in FIG. 1, when the endless band 172 is placed over the rotatable tubular shell 12. Depending on the parameters of the magnetic field and the speed of rotation of the drum 112, these adhered particles can move either in the direction concurring with the direction of the rotation of drum 112 (i.e., counterclockwise in the example shown in FIG. 1) or opposite to that of the rotation of drum 112 (i.e., clockwise in the example shown in FIG. 1). For example, the drum 112 can rotate at an angular speed ranging from about 30 rpm to 1500 rpm (revolutions per minute) and even faster. To cause movement of the strongly magnetic particles $M_1$ in the direction opposite to the direction of rotation of the drum 112, appropriate parameters of the magnetic field (i.e., induction and gradient) in the magnetic field region formed along the exterior surface 121 of the tubular shell 12 should be provided. Preferably, the strongly magnetic particles $M_1$ are forced to move with the speed of 0.01%-0.001% of the uniform speed of the drum 112. For example, in order to reach this condition for a mixture $M_0$ containing particles of relatively strong magnetic components (such as magnetite or ferromagnetic scrap) and having a dimension of about 0.05 mm-0.2 mm, for the magnets 111 arranged at distance of 1 mm-1.1 mm from the axis of rotation and rotated with an angular speed in the range of about 30 rpm to 1500 rpm, a value of the magnetic field induction in the vicinity of the magnetic field region can be in the range of 0.15 T-1.0 T.

Hence, due to rotation of the rotatable tubular shell concentrically with the rotatable magnetic source, a conveying channel is formed within the magnetic field region for conveying the first component within the magnetic field region owing to attraction of the first component to the exterior surface of the rotatable tubular shell by the magnetic field generated by the rotatable magnetic source. As shown in FIG. 1, rotation of the magnets 111 together with the rotatable tubular shell 12 conveys the strongly magnetic particles $M_1$ along the conveying channel formed in the magnetic field region formed along the outer surface the endless band 172 in a direction $D_3$ towards the discharge chamber 141 for collecting therein. It should be noted that the second predetermined direction $D_2$ of rotation of the rotatable tubular shell 12 can either concur with or be opposite to the direction $D_1$ of the rotating magnets 111. The rotation of the rotatable tubular shell 12 together with the endless band 172 in the second predetermined direction $D_2$ can facilitate conveyance of the strongly magnetic particles $M_1$ towards the zone where the strongly magnetic particles $M_1$ leave the endless band 172 and are discharged into the first discharge chamber 141. During such conveyance, if the particulate material of the first component $M_1$ is presented in large aggregates, then it can be divided into separated particles owing the tumbling of the particles along the conveying channel.

It should be noted that the combined action of the non-uniform magnetic field created by the rotatable magnetic source 11 together with the centrifugal force created by the rotatable tubular shell 12 can result in the increase of an output product volume of the magnetic separation apparatus by 4-10 times, when compared to the output product volume of the prior art apparatuses which have a provision of a stationary tubular shell (which does not rotate), or do not have a tubular shell at all. Moreover, such construction of the separation apparatus allows changing and finding all the parameters of the apparatus easily and flexibly, in accordance with the needs of a particular separation process performed at a particular zone where such apparatus is installed, thereby to optimally satisfy the conditions of the separation process.

According to the embodiment shown in FIG. 1, the separation apparatus 10 includes a band agitator 18 configured for vibrating the endless band 172 near the zone of discharge of the particular elements of the first component $M_1$ from the endless band 172 into the first discharge chamber 141. Such vibrations of the endless band 172 near the zone of discharge of the first component $M_1$ can prevent adhesion of the particular elements of the first component $M_1$ to the endless band 172. Moreover, the vibrations of the endless band 172 can preclude conglomeration of the particular elements carried by the endless band 172.

According to the embodiment shown in FIG. 1, the band agitator 18 includes a plate 181 made of a non-magnetic material, that bears one or more agitating strips 182 made of a soft magnetic material. The plate 181 is mounted in the vicinity of the interior surface 174 of the endless band 172. The plate 181 can, for example, be mounted at a distance of about 5 mm-50 mm from the zone of discharge of the first component $M_1$. Moreover, it is important that the plate 181 would be mounted in the proximity to the rotatable magnetic source 11 at a distance sufficient for electromagnetic interaction of the magnets 111 of the rotatable magnetic source 11 with the agitating strips 182. In operation, the magnets 111 of the rotatable magnetic source 11 can induce eddy currents in the agitating strips 182, which in turn can interact with the magnetic field created by the rotatable magnetic source 11. As a result of this interaction, the plate 181 can vibrate and bounce the endless band 172, thereby facilitating throwing the particles away from the endless band 172. Amplitude and frequency of this vibration can be determined by the change in magnitude and direction of magnetic induction in the region of location of the agitating strips 182.

Figure 4:
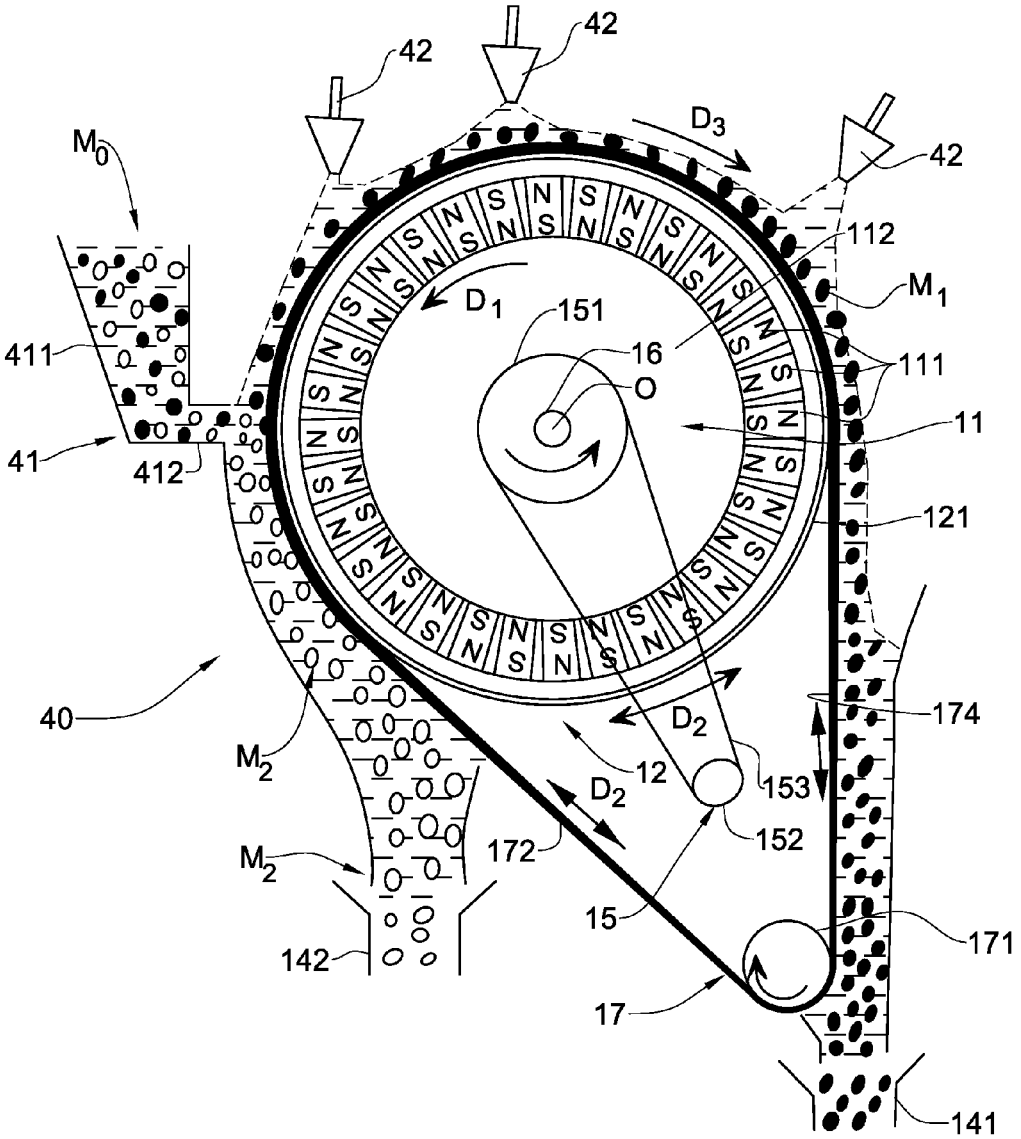
FIG. 4 is a schematic perspective view of a separation apparatus configured for a wet-type magnetic separation, according to one embodiment of the present invention.

The "dry-type" magnetic separation concept described above can also be used for a "wet-type" separation, mutatis mutandis. Referring to FIG. 4, a schematic perspective view of a separation apparatus (generally shown by a reference numeral 40) configured for a wet-type magnetic separation is shown, according to one embodiment of the present invention. The apparatus 40 has generally similar elements as the apparatus (10 in FIG. 1), however it should be associated with a feeder 41 of a "wet-type. The feeder 41 can include a hopper or a trough 411 and a water supply manifold (not shown) coupled to the hopper (or trough) 411 for providing water thereto for mixing the water with the mixture $M_0$. The water is provided into the hopper 411 to form slurry that is directed to a slurry supply chute or inclined slurry supply conduit 412 coupled, for example, to the hopper 411 for delivering the slurry by gravity towards the rotatable tubular shell 12. The water delivered through the water supply manifold is held in the hopper 411 at a desired level by suitably controlling the delivery rate. When desired, the excess of over-flow water can be discharged to an overflow outlet pipe (not shown). When desired, the apparatus 40 can include one or more sprinklers 42 for washing the particulate material of first component $M_1$ during its conveying along or together with the endless band 172.

When desired, the apparatus 40 can be equipped with a band agitator (not shown) for vibrating the endless band 172 near the zone of discharge of the particular elements of the first component $M_1$, as described above.

The operation of apparatus 40 can be likened to the operation of the apparatus (10 in FIG. 1), mutatis mutandis.

Figure 5:
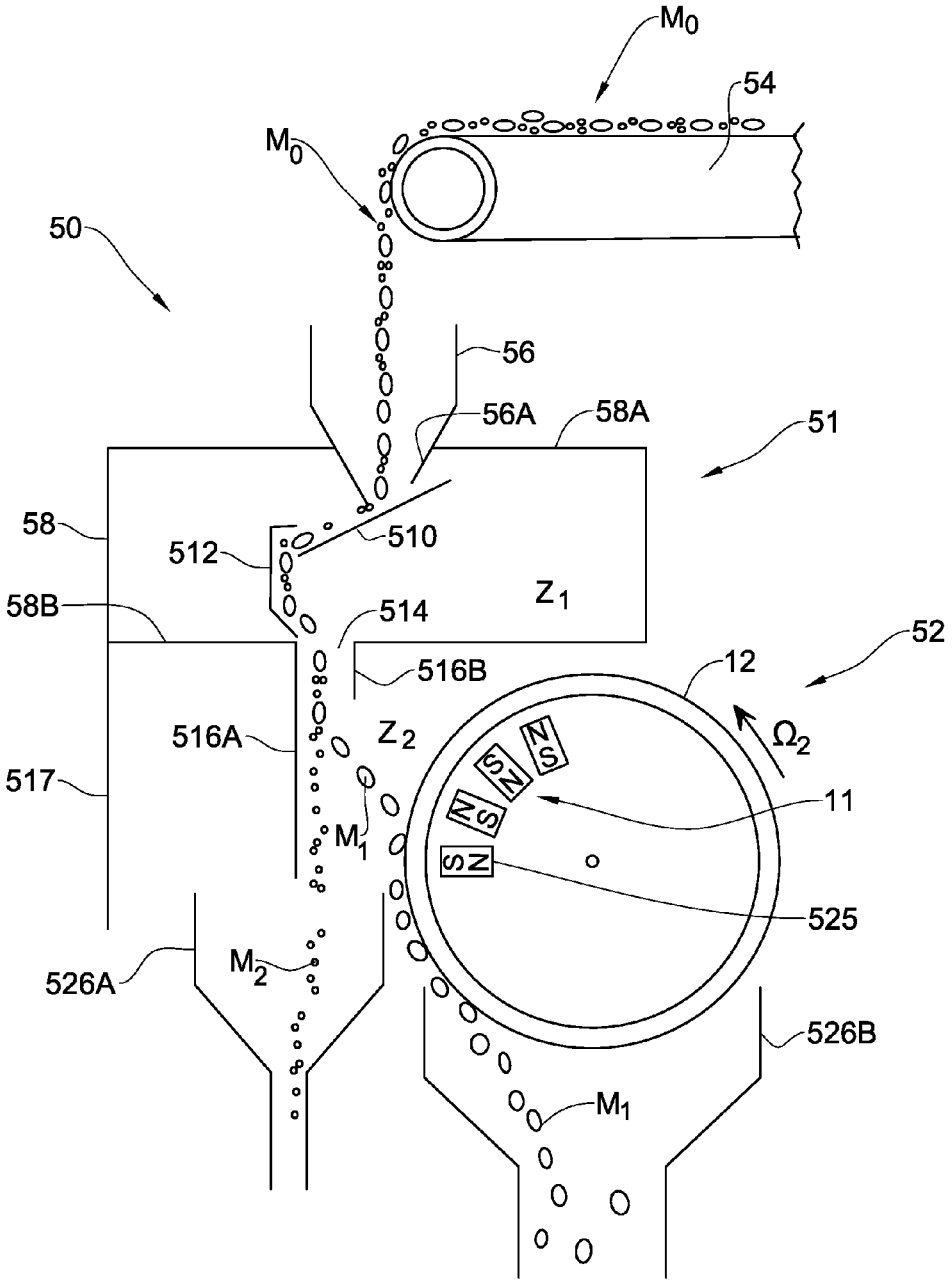
FIG. 5 schematically illustrates the main components of a separation apparatus suitable for separating relatively strong magnetic fractions, constructed according to one embodiment of the invention.

Referring to FIG. 5, there is illustrated a further embodiment of the magnetic separation apparatus, generally designated by a reference numeral 50, for separating particles of relatively strong magnetic fractions, such as magnetite, ferromagnetic scrap, etc., from weakly magnetic and non magnetic fractions (components) contained in a supplied mixture $M_0$. The separation apparatus 50 is associated with a supply conveyer 54 that conveys the material $M_0$ from a suitable loading assembly (not shown) towards the separation apparatus 50.

The apparatus of this embodiment can, for example, be suitable for recovering gold, which is a non-magnetic fraction. The mixture $M_0$ containing gold particles flows through the separation apparatus 50, where the relatively strong magnetic fractions are separated from the remaining portion of the mixture containing relatively weak magnetic and non magnetic fractions.

When desired, this portion of the material can then undergo a further separation stage for separation of weakly magnetic from non magnetic fractions. In other words, the passage of the mixture $M_0$ through the separation apparatus 50 can represent a first separation stage of the entire separation process that may include several stages.

The separation apparatus 50 is designed such that it defines two functionally different zones: a feeding zone $Z_1$ and a separation zone $Z_2$. The separation zone $Z_2$ is defined by a magnetic field region. The zones $Z_1$ and $Z_2$ are separated from each other to prevent the feeding zone $Z_1$ from penetration therein of the magnetic field generated in the separation zone $Z_2$, as will be described more specifically further below.

The separation apparatus 50 comprises a magnetic assembly 52 including rotatable magnetic source 11 and rotatable tubular shell 12 mounted around the rotatable magnetic source 11. The separation apparatus 50 includes a guiding assembly 51 defining the feeding zone $Z_1$ and configured for guiding the mixture material $M_0$ towards the magnetic assembly 52. The guiding assembly 51 includes a chamber 58 coupled to a hopper 56, which is located proximate to the conveyer 54 downstream thereof and directs the supplied mixture material $M_0$ to flow from the conveyer 54 towards the separation zone $Z_2$ through the chamber 58. As can be seen in FIG. 5, a front end 56A of the hopper 56 (with respect to the direction of the material flow) is inserted into an appropriate inlet opening made in a top wall 58A of the chamber 58.

The guiding assembly 51 also includes an agitating member 510 accommodated inside the chamber 58 proximate to the hopper 56. The agitating member 510 serves for dispersing the mixture material $M_0$ towards the separation zone $Z_2$ during the flow of the material. As an example of the agitating member 510, a vibrating plate is shown in FIG. 5; however other examples are also contemplated.

The guiding assembly 51 further includes a deflection member 512 (provided within the feeding zone $Z_1$), which is located next to the agitating member 510. The deflection member 512 directs the material flow out of the chamber 58 through an outlet opening 514 at the bottom 58B of the chamber 58. A pair of parallel, spaced-apart shutters 516A and 516B projects downwardly from the opening 514 and defines a further flow path of the mixture material $M_0$ towards the separation zone $Z_2$.

The chamber 58 and the shutters 516A and 516B form together a guiding assembly for guiding the directional movement of the mixture material $M_0$ from the conveyer 54 to the separation zone $Z_2$. It is important to note that the shutters 516A and 516B, and a housing of the entire chamber 58 are made of a ferromagnetic material, for example, soft magnetic steel. This provides substantial screening (shielding) of the mixture material $M_0$ from the magnetic field created by the magnetic source within the separation zone $Z_2$, as long as the mixture $M_0$ is located within the feeding zone $Z_1$ (i.e., prior to entering the separation zone $Z_2$). The screening of the mixture $M_0$ from the magnetic field is desired for avoiding magnetization of the mixture material $M_0$ resulting in conglomeration of the material and forming large particles (i.e., floccules).

When desired, a plate 517 made from a magnetic material made be provided that projects downward from the bottom of the chamber 58 for strengthening the magnetic field in the separation zone $Z_2$. The separation apparatus 50 so designed provides the flow of the mixture $M_0$ in its suspended state towards the separation zone $Z_2$, thereby avoiding the undesirable "flocculation" effect.

The magnetic assembly 52 is mounted downstream of the chamber 58 and the shutters 516A and 516B of the guiding assembly 510. The magnetic assembly 520 comprises the rotatable magnetic source 11 and the rotatable tubular shell 12 mounted around the magnetic source and configured for rotating concentrically therewith. It was found that separation can already be achieved when the rotatable magnetic source 11 is not rotated.

As described above, the magnetic source 11 can include a plurality of permanent magnets or electromagnets 525 (only four magnets 525 are shown in FIG. 5), circumferentially arranged proximate to the inner surface of the rotatable tubular shell 12. The magnets 525 generate a substantially weak (e.g., 0.05 T-1.2 T), low gradient (e.g., 0.02 T/cm-2.0 T/cm) magnetic field within a magnetic gap (i.e., magnetic field region) in the vicinity of the magnets. It should be noted that the permanent magnets could be replaced by one or more electromagnets.

Rotation of the rotatable tubular shell 12 results in the fact that the circumferential portion thereof becomes located in a magnetic region. The mixture material $M_0$ flows through at least a portion of this magnetic region, and a first fraction $M_1$ having strongly magnetic properties is attracted by the magnetic field and becomes adhered to the successive circumferential portions of the tubular shell 12 located in the magnetic region. The remaining fraction $M_2$ of the material $M_0$, whilst being not affected by the magnetic field, continues its directional flow into a discharge chamber 526A or the like to be conveyed towards a further separator (not shown). The adhered fraction $M_1$ is discharged from the circumferential portions of the tubular shell 12 as it ensues from the magnetic region, and flows into an appropriately mounted discharge chamber 526*b*.

Figure 6:
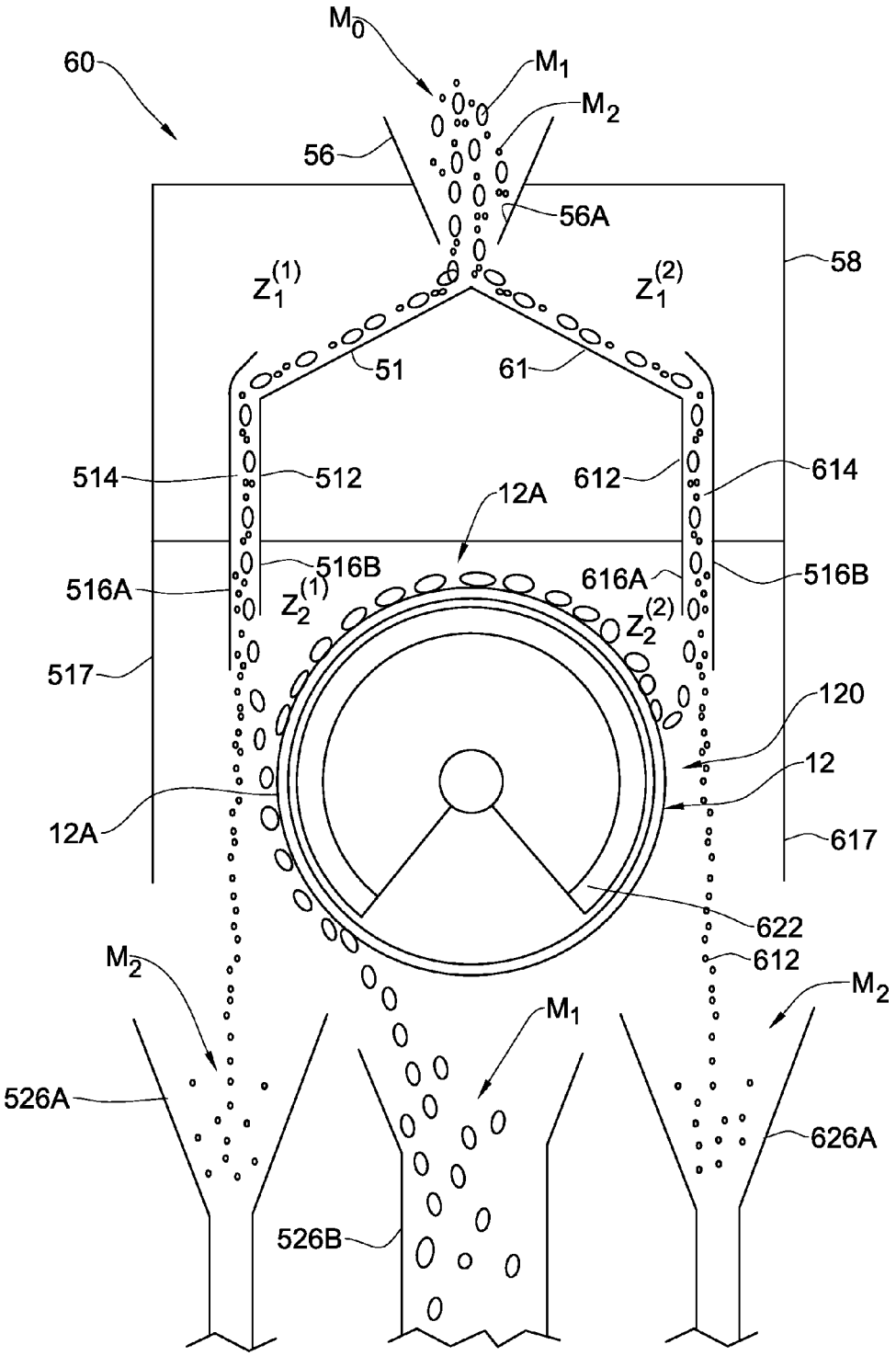
FIG. 6 schematically illustrates the main components of a separation apparatus for separating relatively strong magnetic fractions, constructed according to another embodiment of the invention.

FIG. 6 illustrates a separation apparatus 60, which is based on the same basic principle as the separation apparatus (50 shown in FIG. 5), but has a somewhat different construction, as compared to the apparatus 50. In order to facilitate understanding, the same reference numbers are used for identifying those components, which are identical in the separators 50 and 60.

In the separator 60, the feeding zone is formed by two spatially separated sub-zones $Z_1^{(1)}$ and $Z_1^{(2)}$. The feeding sub-zones $Z_1^{(1)}$ and $Z_1^{(2)}$ are located symmetrically with respect to the drum's axis, so as to feed the mixture material $M_0$ simultaneously onto two opposite circumferential portions of the tubular shell 12, thereby speeding up the separation process.

To this end, the hopper 56 is accommodated centrally above the tubular shell 12, and an additional feeder 61, which is symmetrically identical to the feeder 51, is mounted inside the chamber 58 below the lower end 56A of the hopper 56. Consequently, an additional deflector 612 symmetrically identical to the deflector 512 is provided being associated with the additional feeder 61. The chamber 58 is formed with one additional outlet opening 614 (additional to the opening 514), associated with an additional pair of shutters 616A and 616B, and an additional downwardly projecting plate 617 (additional to the plate 517). The separation apparatus 60 so designed provides the flow of the mixture $M_0$ in its suspended state towards the separation zones $Z_2^{(1)}$ and $Z_2^{(2)}$, thereby avoiding the undesirable "flocculation" effect.

It should be noted, although not specifically shown, that the magnetic source 11 may similarly comprise a plurality of permanent magnets or electromagnets. A discharge chamber 626A in addition to the discharge chamber 526A is appropriately accommodated downstream of the tubular shell 12 for receiving a corresponding part of the particles $M_2$ which are not affected by the magnetic field.

The separator 60 operates similarly to the separator 50. Namely, the mixture material $M_0$ that is to undergo the separation flows through the guiding assembly located in the feeding zone $Z_1$, from where it is directed towards the magnetic field region located in the separation zone $Z_2$. The relatively strong magnetic fraction $M_1$ contained in the mixture material $M_0$ becomes adhered to the circumferential portion 12A of the tubular shell 12 located at its top in the magnetic field region. When rotation of the tubular shell 12 brings these successive portions down, so that they pass the circumferential portion 12B, the fraction $M_1$ is discharged from the tubular shell 12 to the discharge chamber 526B. The remaining material $M_2$, whilst not being affected by the magnetic field, flows at opposite sides of the tubular shell 12 towards the vessels 526A and 626A, respectively.

Figure 7A:
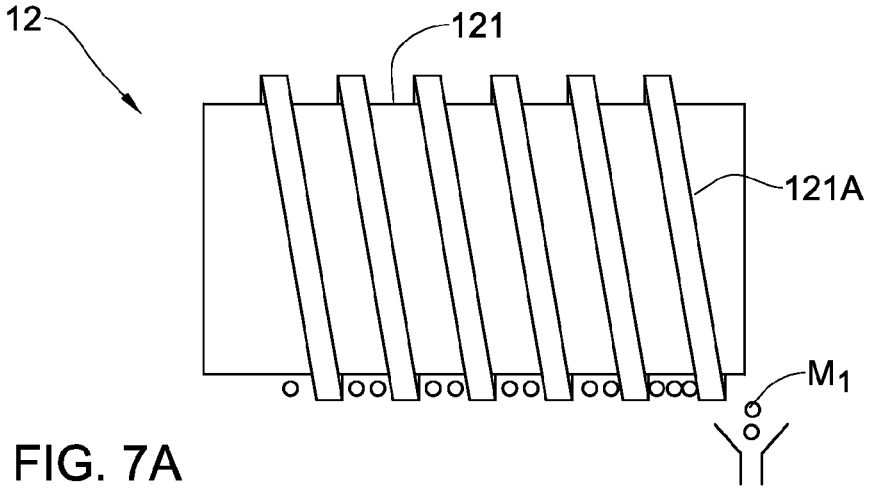
FIGS. 7A to 7C illustrate three different examples, respectively, of a discharging profile suitable for use in the separation apparatus.
Figure 7B:
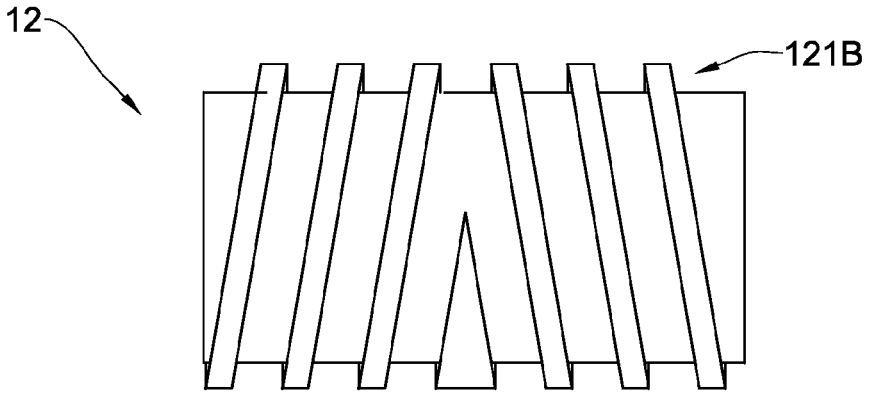
Figure 7C:
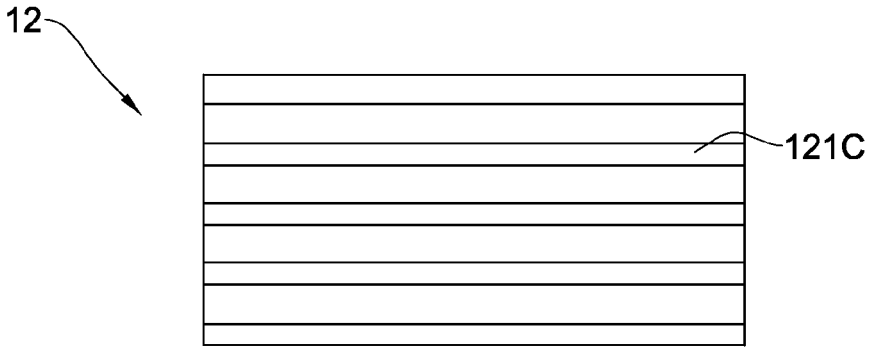

The discharging procedure can be improved by appropriately designing an exterior surface of the tubular shell 12. FIGS. 7A-7C show three different examples, respectively, of the exterior surface 121 of the tubular shell 12 having differently designed discharging profiles. In FIG. 7A, a discharging profile 121A is in the form of an external helical screw turning in the same direction around the entire exterior surface 121. It is understood that the rotation of the drum will cause the particles located on its surface to be conveyed away from the exterior surface 121.

A discharging profile 121B shown in FIG. 7B has two parts of external helical threads turning in two directions around entire exterior surface 121. These two parts are identically symmetrical and coupled to each other at the central portion of the tubular shell 12.

In the example of FIG. 7C, a discharging profile 121C of the exterior surface of the tubular shell is formed by a plurality of projections mounted on the exterior surface 121 (screw-shaped) in a spaced-apart parallel manner, oriented along the axis of rotation of the drum.

It should be understood that, when desired, each of the described above embodiments of the magnetic separation apparatus can be utilized in a multistage separation process.

Figure 8:
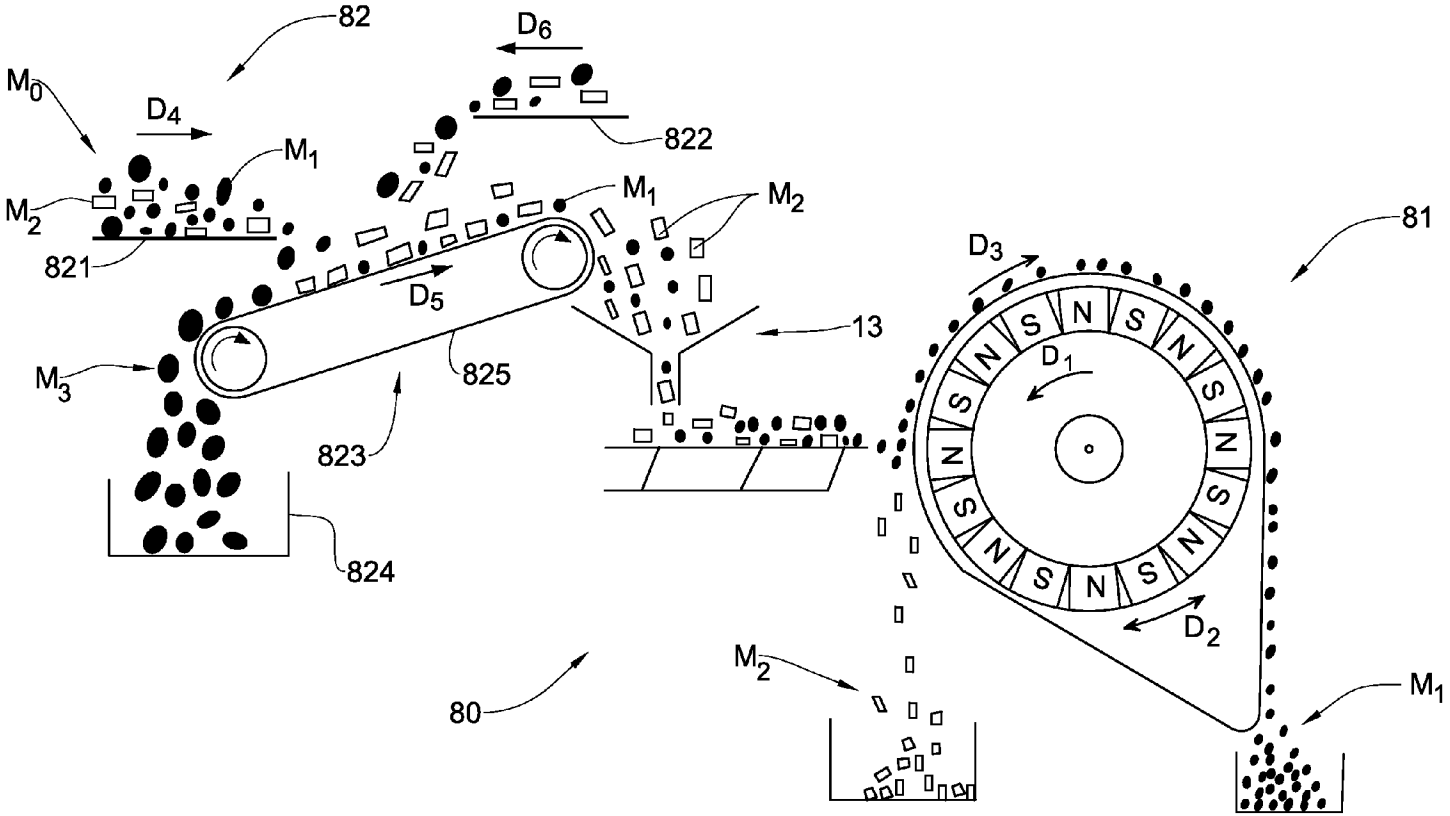
FIG. 8 schematically illustrates a separation system for multistage separation of relatively strong magnetic fractions, constructed according to an embodiment of the invention.

FIG. 8 schematically illustrates a separation system 80 for multistage separation of relatively strong magnetic fractions, constructed according to an embodiment of the invention. The separation system 80 includes a separation apparatus 81 of any one of the embodiments described above, and a pre-separating assembly 82 configured for preliminary separation of a component $M_3$ of large particles of a particulate mixture material $M_0$ that contains three components $M_1$, $M_2$ and $M_3$. For example, the mixture material $M_0$ can be a mixture containing electronic components (e.g., chips $M_2$) and a media mixture (e.g., regular ferromagnetic balls $M_1$ as well as large ferromagnetic particles $M_3$ formed due to the adhering of the fabrication material on certain regular ferromagnetic balls or due to the agglomeration of several regular ferromagnetic balls together). Such a mixture $M_0$ can, for example, be formed during hi-tech production of passive electronic components, when after applying nickel coatings on a ceramic substrate, there is a need to separate chips (capacitors, resistors, etc.) having relatively weak magnetic properties) from a media mixture (balls, cylinders, etc.) having strong magnetic properties). The chips are the finished product for sale, whereas the media is returned to the technological process, where it is re-used for applying a nickel coating on a ceramic substrate.

The pre-separating assembly 82 includes one or more vibrating feeders (e.g., two feeders 821 and 822 are shown in FIG. 8), a supply conveyer 823 and a collector 824 for collecting the component $M_3$.

In operation, the mixture $M_0$ including particular elements of the components $M_1$, $M_2$ and $M_3$ can be provided from at least one of the vibrating feeders 821 and 822 to the supply conveyer 823. It should be noted that a direction $D_4$ of supply of the mixture $M_0$ from the vibrating feeder 821 concurs with the direction $D_5$ of the motion of an endless band 825 of the supply conveyer 823. On the other hand, a direction $D_6$ of supply of the mixture $M_0$ from the vibrating feeder 822 is opposite to the direction of the motion of the endless band 825. It should be noted that the supply of the mixture $M_0$ in the direction opposite to the direction of the motion of the endless band 825 is more preferable than the supply in the same direction. When the components of the mixture $M_0$ are tumble down on the supply conveyer 823, the large particles of the component $M_3$ roll down to the collector 824, whereas the mixture containing the components $M_1$ and $M_2$ is further supplied by the supply conveyer 823 to the feeder 13 of the separation apparatus 81. A further separation of the mixture containing the components $M_1$ and $M_2$ is carried out as described above with reference to FIGS. 1, 4, 5 and/or 6.

EXAMPLES

The essence of the present invention can be better understood from the following non-limiting examples which are intended to illustrate the present invention and to teach a person of the art how to make and use the invention. These examples are not intended to limit the scope of the invention or its protection in any way.

Example 1

The separation apparatus shown in FIG. 1 was constructed and tested for recovering gold from the mixture containing strongly magnetic fractions, such as magnetite. A rotatable magnetic source 11 having radially oriented permanent magnets creating magnetic field region characterized by the magnetic field in the range of 0.05 T-1.2 T with a gradient in the range of 0.02 T/cm-2.0 T/cm, was used. The magnets were located at a distance of 0.88 m from an axis of rotation of the rotatable magnetic source that performed 300 rpm (revolutions per minute) and had a width of a working zone of 0.9 m. The magnets were made of Ferrous-Barium and shaped like flattened rectangular blocks, each of about 135 mm length, about 120 mm height and 93 mm width.

The rotatable tubular shell 12 (mounted around the rotatable magnetic source) had a diameter of 1 m and a height of the conveying channel of 60 mm. A rotatable tubular shell 12, performing 90 revolutions per minute, was used.

Table 1 shows the maximal dimension of the particles of the supplied material, the concentration of the first component having relatively strong magnetic properties in the mixture, contents of gold in the fraction of the first component after separation, contents of gold in the fraction of the second component and the gold fraction recovered from the table concentrate (probes 1 and 3) and the head of the table concentrate (probe 2).

TABLE 1

| Probe N | Size particles, mm | First component content in material, % | Content of gold in the fraction of the first component after separation, g/t | Content of gold in the fraction of the second component after separation, g/t | Gold extract to non magnetic fraction after separation, % |
|---|---|---|---|---|---|
| 1 | −5 +0.0 | 31.81 | 1502.11 | 325074.46 | 99.78 |
| 2 | −5 +0.0 | 20.24 | 837.30 | 491794.98 | 99.78 |
| 3 | −5 +0.0 | 48.93 | 1474.00 | 280165.22 | 99.5 |

As can be understood from Table 1, the loss of the gold does not exceed 0.5%. The weight output of the apparatus with the rotatable tubular shell was 120 tons/hour, whereas the weight output of the similar apparatus with the stationary tubular shell was 10 tons/hour.

Example 2

The separation apparatus shown in FIG. 5 was constructed and tested for recovering gold from the mixture containing strongly magnetic fractions for hard-to-enrich tailings of a tray. The results of the recovering are shown in Table 2.

TABLE 2

| Probe N | Size particles, mm | First component content in material, % | Content of gold in the fraction of the first component after separation, g/t | Content of gold in the fraction of the second component after separation, g/t | Gold extract to non magnetic fraction after separation, % |
|---|---|---|---|---|---|
| 1 | −5 +0.0 | 64.11 | 48.74 | 39681.87 | 99.78 |
| 2 | −5 +0.0 | 65.36 | 49.90 | 42413.18 | 99.78 |
| 3 | −5 +0.0 | 66.95 | 238.96 | 40909.97 | 99.83 |
| 4 | −5 +0.0 | 64.66 | 51.50 | 38058.65 | 99.75 |
| 5 | −5 +0.0 | 64.13 | 43.48 | 40306.35 | 99.81 |

As can be understood from Table 2, the loss of the gold does not exceed 0.25%.

As such, those skilled in the art to which the present invention pertains, can appreciate that while the present invention has been described in terms of preferred embodiments, the concept upon which this disclosure is based may readily be utilized as a basis for the designing of other structures, systems and processes for carrying out the several purposes of the present invention.

Although in the above embodiments the conveying channel formed along the outer surface the endless band 172 is opened to the environment (i.e., "open-type channel), it should be understand that when desired, the conveying channel can be surrounded by walls to form a so-called "close-type" channel or "isolated-type" channel. This provision allows for avoiding an undesirable effect of "jumping aside" of the separated particulate elements.

Also, it is to be understood that the phraseology and terminology employed herein are for the purpose of description and should not be regarded as limiting.

Finally, it should be noted that the word "comprising" as used throughout the appended claims is to be interpreted to mean "including but not limited to".

It is important, therefore, that the scope of the invention is not construed as being limited by the illustrative embodiments set forth herein. Other variations are possible within the scope of the present invention as defined in the appended claims. Other combinations and sub-combinations of features, functions, elements and/or properties may be claimed through amendment of the present claims or presentation of new claims in this or a related application. Such amended or new claims, whether they are directed to different combinations or directed to the same combinations, whether different, broader, narrower or equal in scope to the original claims, are also regarded as included within the subject matter of the present description.

The invention claimed is:

1. An apparatus for magnetic separation of a first component having relatively strong magnetic properties from a mixture containing said first component and at least one other component having relatively weak magnetic properties as compared to those of the first component, the apparatus comprising:

a magnetic source system mounted for rotation about an axis, the magnetic source system being configured and operable for generation of a predetermined non-uniform magnetic field at a predetermined distance from the axis of rotation, thereby creating a magnetic field region while rotating in a first predetermined direction, defining a separation zone in the magnetic field region; and a tubular shell mounted around the rotatable magnetic source within said magnetic field region, the tubular shell being configured and operable for rotating concentrically with said rotatable magnetic source in a second predetermined direction to thereby form a conveying channel within said magnetic field region, said conveying channel for conveying the first component within said magnetic field region owing to attraction of the first component to an exterior surface of the rotatable tubular shell by the magnetic field generated by the rotatable magnetic source;

wherein said rotatable tubular shell is associated with a tubular shell driver configured for rotating said rotatable tubular shell in said second predetermined direction at a predetermined controllably regulated angular velocity;

wherein said tubular shell driver includes an endless band placed on an exterior surface of the rotatable tubular shell, thereby forming said conveying channel for conveying the first component of the mixture along an outer surface of the endless band;

wherein the tubular shell driver comprises a band agitator configured for vibrating the endless band near a zone of discharge of particular elements of the first component from the endless band, said band agitator comprising a plate made of at least one non-magnetic material bearing at least one agitating strip made of a soft magnetic material and mounted in the vicinity of an interior surface of the endless band.

2. The apparatus of claim 1, wherein said magnetic source system comprises:

a plurality of magnets having poles extending radially with respect to the axis of rotation;

a magnetic source driver configured for rotating said plurality of magnets in said first predetermined direction at a predetermined controllably regulated angular velocity.

3. The apparatus of claim 2, wherein said plurality of magnets comprises permanent magnets mounted on an outer surface of a support member.

4. The apparatus of claim 2, wherein said plurality of magnets comprises electromagnets mounted on an outer surface of a support member.

5. The apparatus of claim 3, wherein said support member is a drum and the magnets are arranged along a circumference of the drum.

6. The apparatus of claim 3, wherein said permanent magnets are made of at least one material selected from the following: Ferrous-Barium (FeBa), Samarium-Cobalt (SmCo), Strontium and rare-earth metals.

7. The apparatus of claim 1, wherein the tubular shell driver has one of the following configurations: (a) comprises an electric motor configured for rotating said rotatable tubular shell through said endless band; (b) comprises a band agitator configured for vibrating the endless band near a zone of discharge of particular elements of the first component from the endless band; and (c) an electric motor and a shell pulley secured to said rotatable tubular shell and rotatably driven by the electric motor through the endless belt cooperative with the pulley.

8. The apparatus of claim 1, wherein said plate is mounted in proximity to the rotatable magnetic source at a distance sufficient for electromagnetic interaction of magnets of the rotatable magnetic source with the agitating strips, thereby vibrating said endless band.

9. The apparatus of claim 1, comprising a feeder configured for providing the mixture to said magnetic field region.

10. The apparatus of claim 9, wherein said feeder has at least one of the following configurations: (i) comprises a hopper and a supplier for delivering the mixture to be separated to the rotatable tubular shell; and (ii) a water supply conduit for providing water to the feeder for mixing with the mixture and forming slurry and a slurry supply conduit coupled to a mixing chamber for delivering the slurry towards the rotatable tubular shell.

11. The apparatus of claim 1, comprising a collector including a first discharge chamber and at least one other discharge chamber configured for separately collecting said first material component and said at least one other material component, respectively.

12. An apparatus for magnetic separation of a first component having relatively strong magnetic properties from a mixture containing said first component and at least one other component having relatively weak magnetic properties as compared to those of the first component, the apparatus comprising:

a magnetic source system mounted for rotation about an axis, the magnetic source system being configured and operable for generation of a predetermined non-uniform magnetic field at a predetermined distance from the axis of rotation, thereby creating a magnetic field region while rotating in a first predetermined direction, defining a separation zone in the magnetic field region;

a tubular shell mounted around the rotatable magnetic source within said magnetic field region, the tubular shell being configured and operable for rotating concentrically with said rotatable magnetic source in a second predetermined direction to thereby form a conveying channel within said magnetic field region, said conveying channel for conveying the first component within said magnetic field region owing to attraction of the first component to an exterior surface of the rotatable tubular shell by the magnetic field generated by the rotatable magnetic source; and a guiding assembly for guiding a flow of said mixture to said magnetic field region and defining a feeding zone upstream of said separation zone, wherein said guiding assembly comprises a screening assembly preventing the feeding zone from being affected by the magnetic field produced in the separation zone, wherein said screening assembly comprises: a chamber made of a ferromagnetic material and having inlet and outlet openings and defining a path for the mixture flow towards the separation zone; and at least one pair of shutters projecting from at least one of outlet openings and defining a further path for the mixture flow towards the separation zone, the shutters being made of a ferromagnetic material.

13. The apparatus of claim 12, having at least one of the following configurations: (1) said screening assembly comprises a chamber having inlet and outlet openings and defining a path for the mixture flow towards the separation zone, the chamber being made of a ferromagnetic material; and (2) said guiding assembly divides the feeding zone into two spatially separated sub-zones for feeding two spatially separated flows of the mixture towards different paths through the separation zone.

14. A method for magnetic separation of a first component in the form of a particulate material having relatively strong magnetic properties from a mixture containing said first component and at least one other component having relatively weak magnetic properties as compared to those of the first component, comprising:

generating a predetermined non-uniform magnetic field by a rotatable magnetic source at a predetermined distance from an axis of rotation of the rotatable magnetic source and thereby creating a magnetic field region while rotating in a first predetermined direction, defining a separation zone in the magnetic field region;

mounting a rotatable tubular shell around the rotatable magnetic source in said magnetic field region, wherein said rotatable tubular shell is associated with a tubular shell driver configured for rotating said rotatable tubular shell in said second predetermined direction at a predetermined controllably regulated angular velocity;

wherein said tubular shell driver includes an endless band placed on an exterior surface of the rotatable tubular shell, and a band agitator;

feeding said mixture containing the first component and at least one other component to said magnetic field region, to thereby cause separation of the first component from the mixture; and rotating said rotatable tubular shell concentrically with said rotatable magnetic source in a second predetermined direction to form a conveying channel within said magnetic field region for conveying the first component within said magnetic field region owing to the attraction of the first component to an exterior surface of the rotatable tubular shell by the magnetic field generated by the rotatable magnetic source and enabling collection of said first component being separated;

vibrating the endless band near a zone of discharge of particular elements of the first component from the endless band.

15. The method of claim 14, wherein an angular velocity of the rotatable magnetic source is equal to or different from an angular velocity of the rotatable tubular shell.

16. The method of claim 14, wherein the direction of rotation of the magnetic source concurs with or is opposite to the direction of rotation of the tubular shell.

17. The method of claim 14, comprising washing particulate material of the first component during its conveying along the exterior surface of the rotatable tubular shell.

18. The method of claim 14, comprising preventing a feeding zone from being affected by the magnetic field produced in the separation zone.

* * * * *